US005794353A

United States Patent [19]

Lin

[11] Patent Number: 5,794,353

[45] Date of Patent: Aug. 18, 1998

[54] CAN OPENER

[76] Inventor: Zi-Xiu Lin, 58, Ma Yuan West St., Taichung, Taiwan

[21] Appl. No.: 864,086

[22] Filed: May 28, 1997

[51] Int. Cl.[6] ..... B67B 7/32

[52] U.S. Cl. ..... 30/418; 30/417

[58] Field of Search ..... 30/416, 417, 418, 30/420, 422

[56] References Cited

U.S. PATENT DOCUMENTS

| | | | |
|---|---|---|---|
| 1,628,080 | 5/1927 | Van Leunen | 30/418 |
| 1,825,216 | 9/1931 | Thybony et al. | 30/417 |
| 4,726,119 | 2/1988 | Lee | 30/418 |

FOREIGN PATENT DOCUMENTS

| | | | |
|---|---|---|---|
| 1318 | 5/1912 | United Kingdom | 30/418 |

*Primary Examiner*—Hwei-Siu Payer

[57] ABSTRACT

A can opener has a lower seat, an upper seat disposed on the lower seat, a swivel button disposed on the upper seat, a swivel wing disposed on the upper seat, and a slide block disposed between the lower seat and the upper seat. The lower seat has a slide recess to receive the slide block. The upper seat has an insertion hole, a slide groove, a threaded hole, a channel, a circular hole, a post, a protrusion, a pillar, and a protruded bar. A shaft is disposed on a rotor. The swivel wing has a center hole to receive the shaft. The rotor is inserted in the insertion hole. The slide block has a rod, a column, a slot and a cone-shaped recess hole. A blade holder and a blade are inserted in the hollow slide block. The swivel button has a threaded shank passing through the threaded hole and a tip end inserted in the cone-shaped recess hole.

1 Claim, 5 Drawing Sheets

CAN OPENER

BACKGROUND OF THE INVENTION

The present invention relates to a can opener. More particularly, the present invention relates to a can opener which can cut a portion of a can smoothly.

A conventional can opener may contaminate the food in the can easily. It is difficult to operate a conventional can opener. After the can is opened, the serrated upper edge of the can may hurt the user.

SUMMARY OF THE INVENTION

An object of the present invention is to provide a can opener which can cut a portion of a can smoothly.

Accordingly, a can opener comprises a lower seat, an upper seat disposed on the lower seat, a swivel button disposed on the upper seat, a swivel wing disposed on the upper seat, and a slide block disposed between the lower seat and the upper seat. The lower seat has a slide recess, a round hole and a plurality of through holes. The upper seat has a distal spacing, an insertion hole, a slide groove, a threaded hole, a channel, a plurality of threaded apertures, a circular hole, a post, a protrusion, a pillar, and a protruded bar. The round hole matches the circular hole. A shaft is disposed on a rotor. The swivel wing has a center hole to receive the shaft. The rotor is inserted in the insertion hole. The hollow slide block has a rod, a column, a slot and a cone-shaped recess hole. A blade holder and a blade are inserted in an interior of the hollow slide block. The hollow slide block is placed on the slide recess of the lower seat. A spring has a first end enclosing the pillar and a second end enclosing the column. The swivel button has a threaded shank passing through the threaded hole and a tip end inserted in the cone-shaped recess hole. A plurality of threaded fasteners pass through the respective threaded holes and the respective through apertures to fasten the lower seat and the upper seat together. The distal spacing receives a top portion of a can. The post and the protrusion abut against the top portion of the can. The swivel button is rotated clockwisely to force the hollow slide block to move toward the can until the blade contacts an outer periphery of the can. The swivel wing is rotated clockwisely to force the rotor to contact an inner edge of the can.

DETAILED DESCRIPTION OF THE INVENTION

Figure 1:
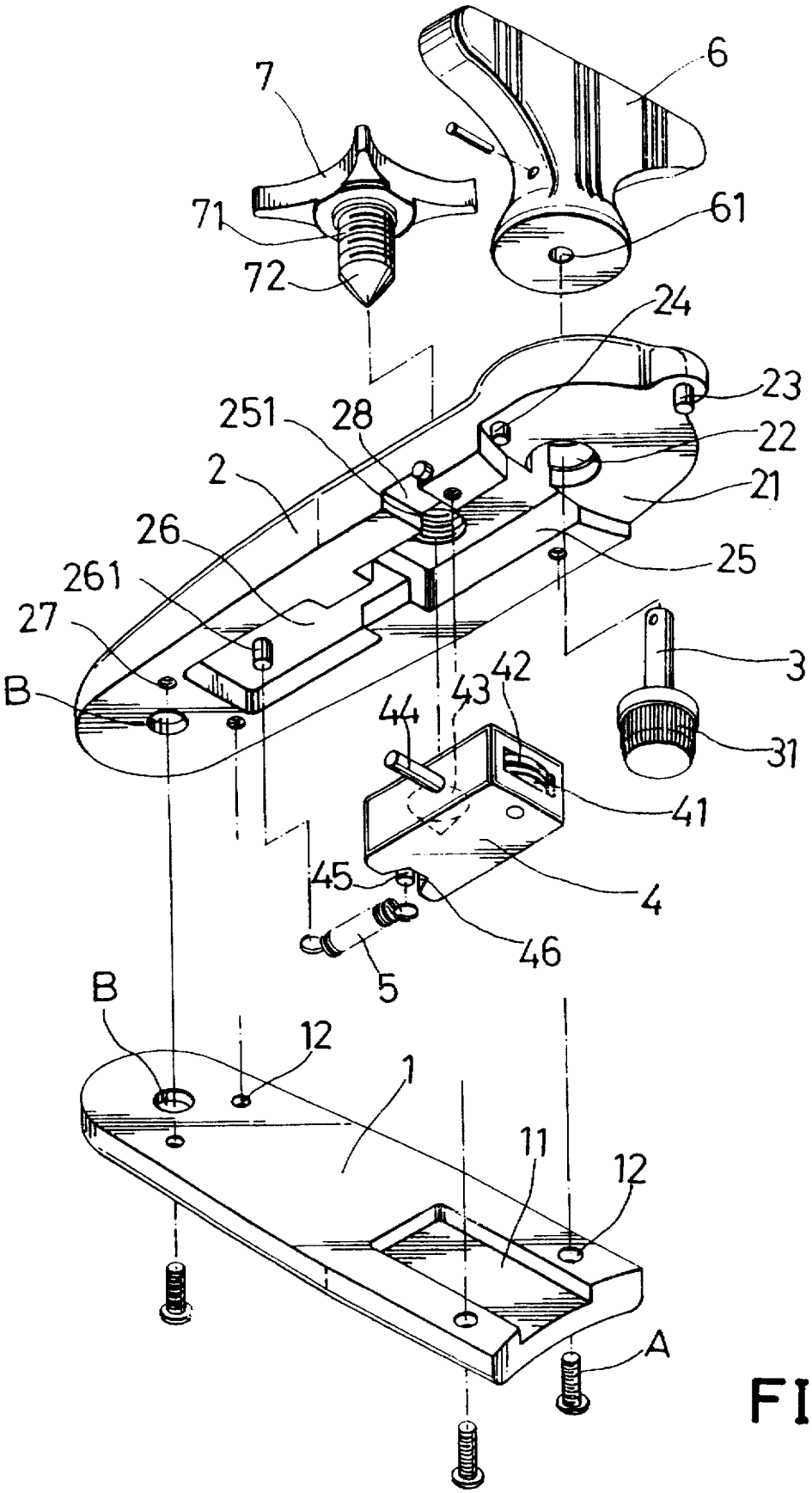
FIG. 1 is a perspective exploded view of a can opener of a preferred embodiment in accordance with the present invention.
Figure 2:
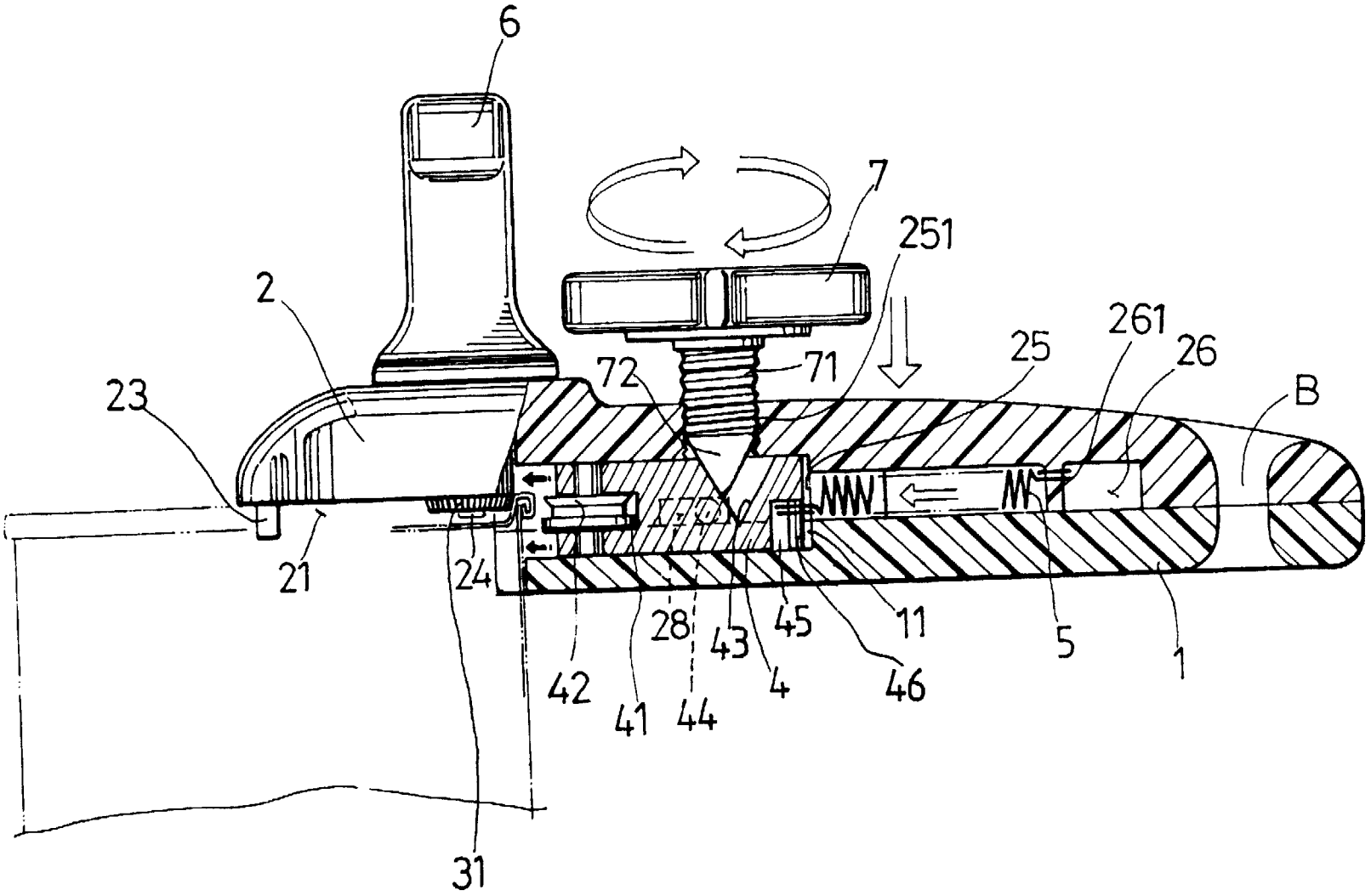
FIG. 2 is a sectional view of a can opener of a preferred embodiment in accordance with the present invention.
Figure 3:
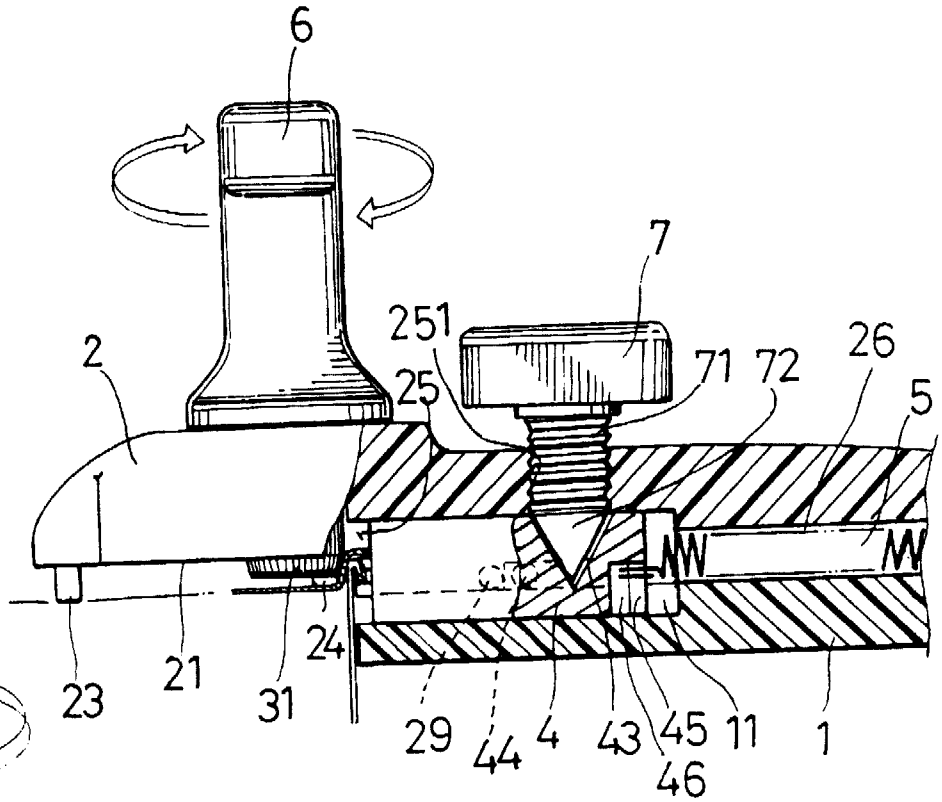
FIG. 3 is a schematic view illustrating an operation of a can opener.
Figure 5:
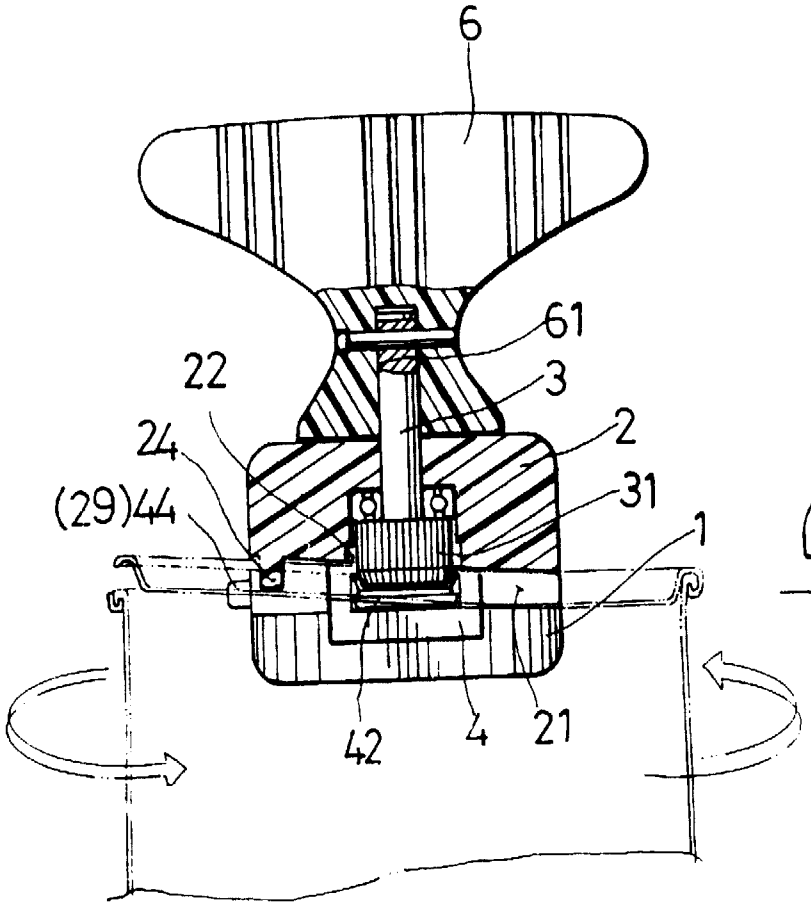
FIG. 5 is a further schematic view illustrating an operation of a can opener.
Figure 4:
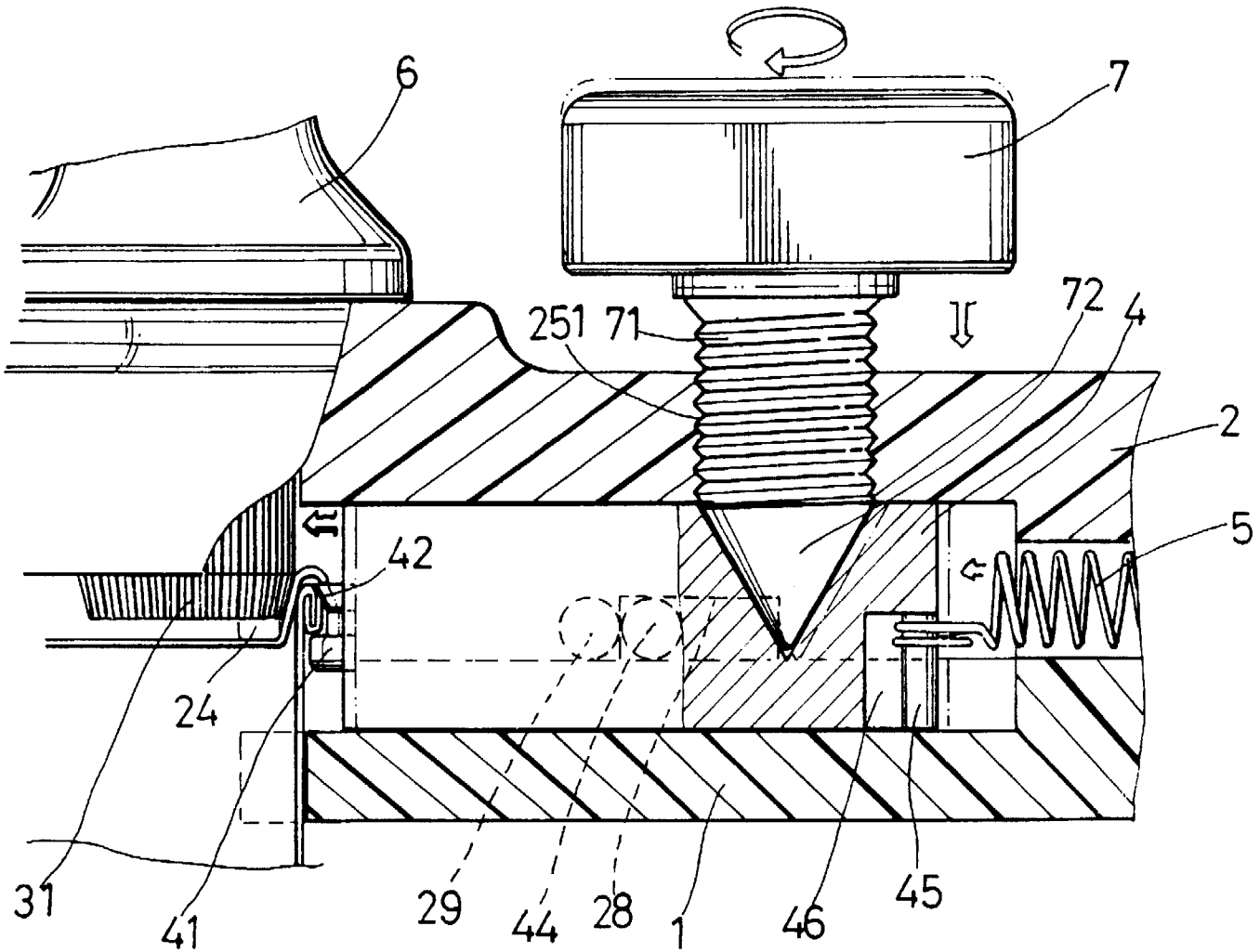
FIG. 4 is another schematic view illustrating an operation of a can opener.
Figure 6:
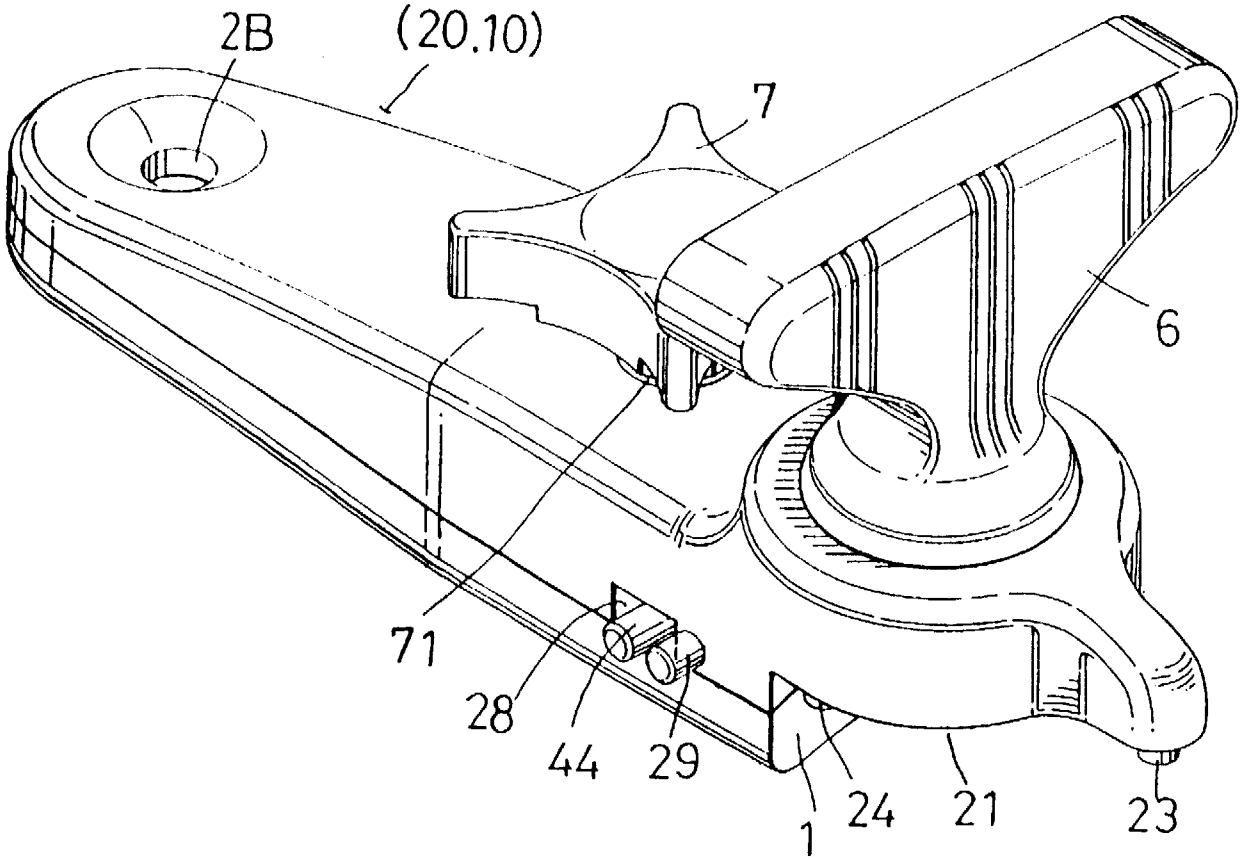
FIG. 6 is a perspective assembly view of FIG. 1.

Referring to FIGS. 1, 2 and 6, a can opener comprises a lower seat 1, an upper seat 2 disposed on the lower seat 1, a swivel button 7 disposed on the upper seat 2, a swivel wing 6 disposed on the upper seat 2, and a slide block 4 disposed between the lower seat 1 and the upper seat 2. The lower seat 1 has a slide recess 11, a round hole 1B and a plurality of through holes 12. The upper seat 2 has a distal spacing 21, an insertion hole 22, a slide groove 25, a threaded hole 251, a channel 26, a plurality of threaded apertures 27, a circular hole 2B, a post 23, a protrusion 24, a pillar 261, a notch 28, and a protruded bar 29. The round hole 1B matches the circular hole 2B. A shaft 3 is disposed on a rotor 31. The swivel wing 6 has a center hole 61 to receive the shaft 3. The rotor 31 is inserted in the insertion hole 22. The hollow slide block 4 has a rod 44, a column 45, a slot 46 and a cone-shaped recess hole 43. A blade holder 41 and a blade 42 are inserted in an interior of the hollow slide block 4. The hollow slide block 4 is placed on the slide recess 11 of the lower seat 1. A spring 5 has a first end enclosing the pillar 261 and a second end enclosing the column 45. The swivel button 7 has a threaded shank 71 passing through the threaded hole 251 and a tip end 72 inserted in the cone-shaped recess hole 43. A plurality of threaded fasteners A pass through the respective threaded holes 12 and the respective through apertures 27 to fasten the lower seat 1 and the upper seat 2 together.

Referring to FIGS. 2 to 5, the distal spacing 21 receives a top portion of a can. The post 23 and the protrusion 24 abut against the top portion of the can. The swivel button 7 is rotated clockwisely to force the hollow slide block 4 to move toward the can until the blade 42 contacts an outer periphery of the can. The swivel wing 6 is rotated clockwisely to force the rotor 31 to contact an inner edge of the can.

The swivel button 7 can be rotated anticlockwisely and the swivel wing 6 can be rotated anticlockwisely so that the can opener can be removed from the can. A nail on the wall can pass through the round hole 1B and the circular hole 2B to hang the can opener on the wall.

The invention is not limited to the above embodiment but various modification thereof may be made. Further, various changes in form and detail may be made without departing from the scope of the invention.

I claim:

1. A can opener comprises:

a lower seat, an upper seat disposed on the lower seat, a swivel button disposed on the upper seat, a swivel wing disposed on the upper seat, and a slide block disposed between the lower seat and the upper seat, the lower seat having a slide recess, a round hole and a plurality of through holes, the upper seat having a distal spacing, an insertion hole, a slide groove, a threaded hole, a channel, a plurality of threaded apertures, a circular hole, a post, a protrusion, a pillar, and a protruded bar, the round hole matching the circular hole, a shaft disposed on a rotor, the swivel wing having a center hole to receive the shaft, the rotor inserted in the insertion hole, the slide block having a rod, a column, a slot and a cone-shaped recess hole, a blade holder and a blade inserted in an interior of the slide block, the slide block placed on the slide recess of the lower seat, a spring having a first end enclosing the pillar and a second end enclosing the column, the swivel button having a threaded shank passing through the threaded hole and a tip end inserted in the cone-shaped recess hole, and a plurality of threaded fasteners passing through the respective through holes and the respective threaded apertures to fasten the lower seat and the upper seat together.

* * * * *